US005327115A

United States Patent [19]

Swierczek

[11] Patent Number: 5,327,115

[45] Date of Patent: Jul. 5, 1994

[54] PROGRAMMABLE DOCUMENT CLIP

[76] Inventor: Remi Swierczek, 9771 Maidstone Dr., Mentor, Ohio 44060

[21] Appl. No.: 921,558

[22] Filed: Jul. 29, 1992

[51] Int. Cl.[5] ..... G08B 1/00

[52] U.S. Cl. ..... 340/309.15; 368/10; 368/278; 340/572

[58] Field of Search ..... 340/309.15, 815.01, 340/568, 572, 571; 116/308, DIG. 44; 40/358, 316, 317, 658, 666, 667; 368/10, 28, 30, 244, 250, 276, 278, 327

[56] References Cited

U.S. PATENT DOCUMENTS

| | | | |
|---|---|---|---|
| 3,701,987 | 10/1972 | Leighton | 340/572 |
| 4,286,358 | 9/1981 | Levin | 40/658 |
| 4,492,479 | 1/1985 | Hatsuse et al. | 368/276 |
| 4,717,042 | 1/1988 | McLaughlin | 221/3 |
| 4,741,001 | 4/1988 | Ma | 368/10 |
| 4,761,862 | 8/1988 | Hiromori | 40/658 |
| 4,768,176 | 8/1988 | Kehr | 368/10 |
| 4,768,177 | 8/1988 | Kehr | 368/10 |
| 4,962,491 | 10/1990 | Schaeffer | 368/10 |
| 5,097,429 | 3/1992 | Wood et al. | 368/10 |

FOREIGN PATENT DOCUMENTS

| | | | |
|---|---|---|---|
| 3509665 | 9/1986 | Fed. Rep. of Germany | 368/10 |
| 0874253 | 4/1942 | France | 368/278 |
| 0033567 | 3/1977 | Japan | 368/278 |

*Primary Examiner*—Brent Swarthout

*Attorney, Agent, or Firm*—Oldham, Oldham & Wilson Co.

[57] ABSTRACT

A device for keeping track of critical dates relative to a specific file or collection of papers and alerting the responsible individual as to the same. The device consists essentially of a programmable timer unit having a LCD screen and/or alarm mechanism coupled with a means for physical attachment to a document or folder.

13 Claims, 2 Drawing Sheets

PROGRAMMABLE DOCUMENT CLIP

TECHNICAL FIELD

This invention relates, generally, to a device for alerting an individual that a particular case, file or collection of documents requires attention or immediate action, and more specifically to a paper clip, binder or other means for physically maintaining the organization of papers or documents coupled with a device informing that individual that such collection of papers or documents require attention or action.

BACKGROUND OF THE INVENTION

Executives, secretaries, entrepreneurs, office workers and individuals have employed countless techniques, methods, systems and/or aids, ranging from simple reminder notes to complex computerized docketing systems, to assist them in tracking critical deadlines associated with specific files or documents. However, as Murphy's law would have it, all systems can and will fail usually doing so at the worst possible time. Another common problem is the dissociation of the deadline reminder and the file. Either the individual knows that a certain action is needed but can not find the file, or the individual has the documents but has mislaid information regarding the due date. Oftentimes, the documents or files are simply filed away in a file cabinet or buried in a virtual sea of paperwork on top of "someone's" desk.

For the foregoing reasons, the applicant has developed and herein presents the following invention.

SUMMARY OF THE INVENTION

The present invention presents a device for alerting an individual as to an impending deadline or the need to give attention to a specific file or document. The device consists of a miniaturized timer unit secured to a paper clip, binder clip or other means for physical attachment to a single document, file or collection of the same. The timer unit of the device is programmed with one or more critical dates corresponding to the required action and the entire device is attached to the document or file. The device is programmed to provide a visual and/or audible signal at a prescribed time in advance of the critical date(s) or time(s) and to continue emitting periodic signals until the document or file has received the appropriate attention. Certain embodiments incorporate differentiated or combined signals or increase the frequency of a signal as the critical date draws closer or arrives, drawing additional attention to the document or file.

It is a principal object of the present invention to provide a device for alerting individuals of critical dates associated with a specific document or file.

It is a further object of the present invention to provide an inexpensive and simple device for alerting individuals of critical dates associated with a specific document or file.

It is yet a further object of the present invention to provide a device for alerting individuals of critical dates associated with a specific document or file which physically attaches to the file and produces a signal drawing specific attention to the file.

These and other objects and advantages of the present invention will become more readily apparent from the more detailed description of the preferred embodiments taken in conjunction with the drawings.

DETAILED DESCRIPTION OF THE PREFERRED EMBODIMENTS

Figure 1:
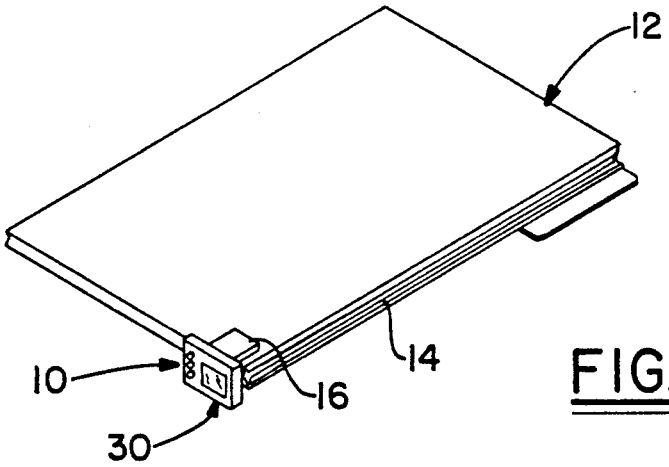
FIG. 1 is a perspective view of a typical file or document to which a preferred embodiment of the present invention has been attached.

Referring now to the figures, FIG. 1 illustrates a perspective view of a typical file 12 containing a collection of documents 14 employing a preferred embodiment of the present invention 10. Generally, the present invention 10 is a device for alerting an individual that a particular case, document or file requires specific attention or action. The device 10 consists of a miniaturized timer unit 30 secured to file attachment member 16 such as a paper clip, binder clip or other means for physical attachment to a document 14 or file 12. While it is recognized that the present invention may be used with a single document, collection of documents or a file, for ease of discussion the term "file" will be used to collectively refer to all of the foregoing.

Figure 2:
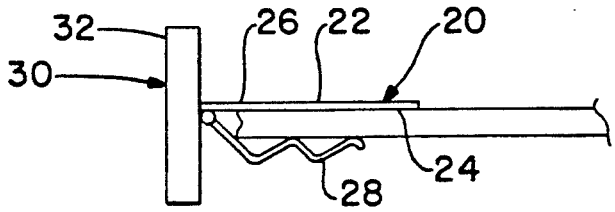
FIG. 2 is an elevational side view of a typical file incorporating a preferred embodiment of the present invention.
Figure 3:
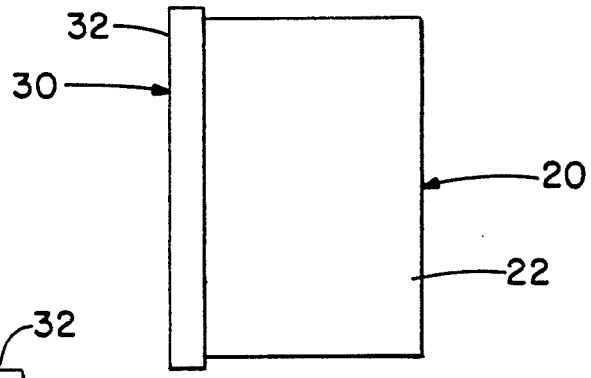
FIG. 3 is a top view of the embodiment of the present invention disclosed in FIG. 2.
Figure 4:
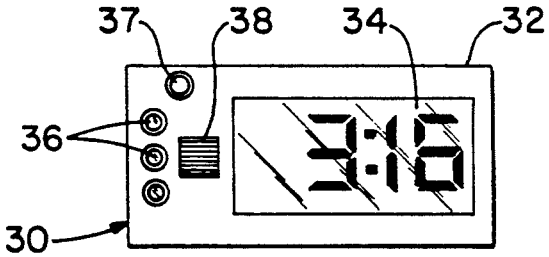
FIG.4 is a front elevational view of a timer unit portion of a preferred embodiment of the present invention.

As shown in FIGS. 2–4, a preferred embodiment of the file attachment member 16 is illustrated as a spring clip 20. This spring clip 20 consists of a plate member 22 to which a clip member 28 is pivotably attached along a portion of plate member 22's periphery. Clip member 28 is biased into engagement with the lower surface 24 of plate member 22 by means known in the art such as through configuration of said clip member or use of a spring (not shown) but with sufficient tension to retain one or more pages therebetween.

Plate member 22 is composed of any relatively rigid material such as a sheet metal or plastic and configured in virtually any shape or size. Additionally, plate member 22 can be covered with a coating or plating for either decorative purposes or to prevent damage caused by abrading, tearing or staining to documents subsequently brought into contact with spring clip 20. Upper surface 26 of plate member 22 may further serve to receive instructional, ornamental or promotional material thereon.

In the embodiment illustrated in FIGS. 2–4 clip member 28 is preferably comprised of a rigid metallic material such as tinned steel wire of varying diameter although it should be appreciated that certain rigid plastic materials may be equally suitable. Still further, clip member 28 is also contemplated as being made from a plastic or metal sheet material molded or modified to retain documents between clip member 28 and plate member 22. FIG. 2 illustrates clip member 28 as having a modified W" shape from a side or cross-sectional view. However, numerous alternative configurations of clip member 28 which accomplish the purpose of the invention including members which are flat curvilinear and the like are contemplated, including that illustrated in FIG. 5.

In the preferred embodiment illustrated in FIGS. 2–4 a timer unit 30 is attached to file attachment member 16, shown as spring clip member 20. Timer unit 30 is preferably secured to an outer edge of and perpendicular to plate member 22, as shown in FIG. 2. The timer unit is most preferably of the liquid crystal display (LCD) variety commonly manufactured and sold by companies such as Toshiba and Casio.

Figure 11:
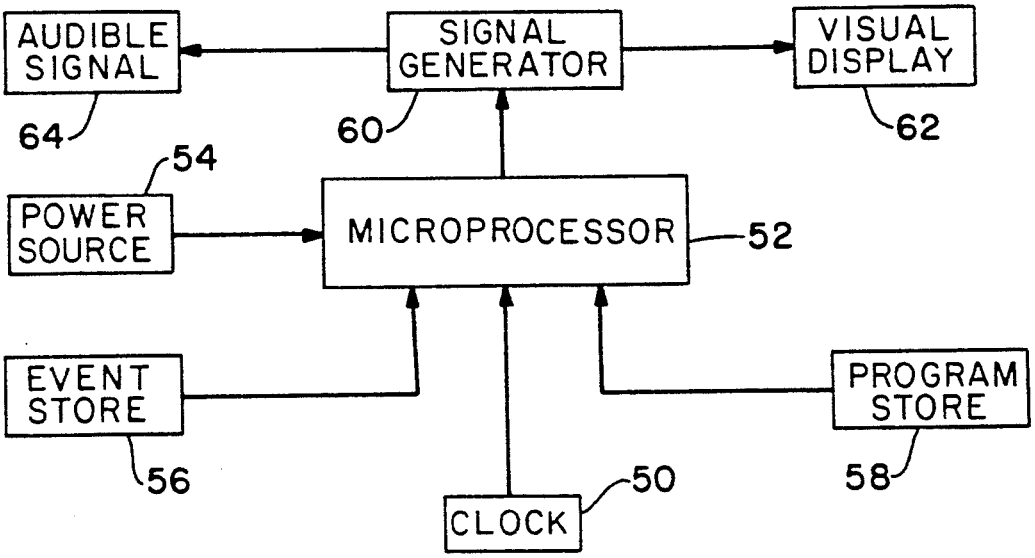
FIG. 11 is a schematic diagram illustrating the basic components of the timer unit of the present invention.

This timer unit 30, as diagrammatically illustrated in FIG. 11, has a housing 32 containing an internal clock mechanism 50 controlled with a microprocessor chip 52 and powered by a miniaturized battery 54. Timer unit 30 is preprogrammed with a prograM 58 detailing the predetermined time(s) and form in which reminder signals, generally 60 are produced. The reminder signals 60 may take the form of visual 62 and/or audible 64 signals. Timer unit 30 has an event storage 56 and is further capable of being programmed with information at least pertaining to the date for which further action on the file is required or desired and potentially but less importantly a specific time for completing the action. After the timer unit 30 has been programmed, the LCD unit 34 will display the critical date.

As shown in FIG. 4, the face of timer unit 30 possesses the LCD unit 34, an optional speaker 38 for communicating audible signals, an optional indicator lamp 37 and a plurality of control buttons 36 for programming timer unit 30 with specific critical date information. Control buttons 36 may include an on/off switch, as well as any number of further buttons necessary or desired to regulate the loading of information regarding month, day, year and/or time of the critical date and may further regulate the number, time and form of the advance notice given by timer unit 30. Control buttons 36 will also include a means for canceling the stored critical date information such that the unit may be reprogrammed with new critical date information.

At a predetermined point prior to the critical date the LCD unit 34 of the preferred embodiment is programmed to flash alternately between the critical date and a solid dark display, warning the individual that the programmed critical date is approaching. At a second predetermined point prior to the critical date, such as 24 hours prior to the established deadline, the timer unit is programmed to increase the frequency of its flashing. Upon the arrival of the due date the LCD display will turn completely dark.

Microprocessor chips 52 capable of performing the above described functions can be purchased from numerous commercial sources readily known to someone of ordinary skill in the art. Alternately, if customization of the functions of device 10 of the present invention is needed, programming of a microprocessor chip 52 to perform such functions could likewise be accomplished by a person of ordinary skill in the art.

Figure 5:
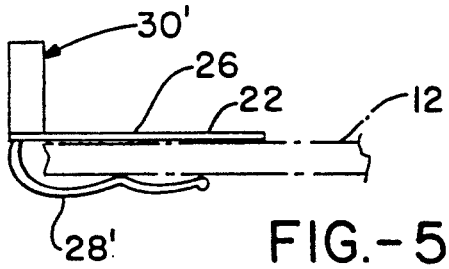
FIG. 5 is an elevational side view of a typical file incorporating another embodiment of the present invention.

FIG. 5 represents an alternative embodiment to device 10 as illustrated in FIGS. 2–4 wherein timer unit 30' is placed on the upper surface 26 of plate member 22. Additionally, an alternatively configured clip member 28' is shown.

Figure 6:
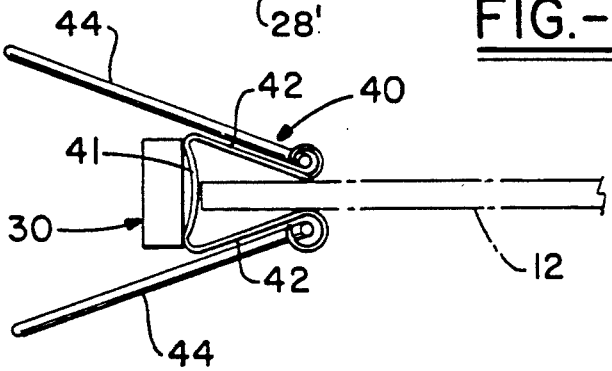
FIG. 6 is an elevational side view of an alternative embodiment of the present invention.
Figure 7:
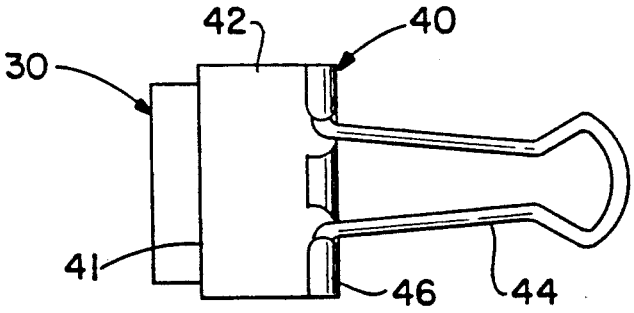
FIG. 7 is a top view of the embodiment of the present invention disclosed in FIG. 6.

FIGS. 6–7 present an alternative embodiment of the present invention wherein the file attachment retaining member 16 is a binder clip 40. Binder clips 40 are commonly used in the art to temporarily secure multiple pages or documents together. The binder clip 40 consists essentially of a generally triangular shaped body having a base 41 and two sides 42 extending from opposite ends of the base and biased into contact with one another at ends distal to the base 41 as caused by the concave configuration of the base 41 relative to sides 42.

Figure 8:
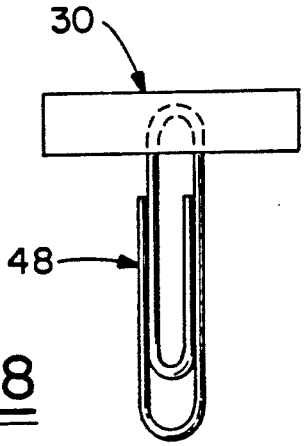
FIG. 8 is a top view of an alternative embodiment of the present invention.

FIG. 8 illustrates the device of the present invention as employing a common paper clip 48 as the invention's file attachment member 16 and wherein a timer unit 30 is attached by any means commonly known in the art.

Figure 9:
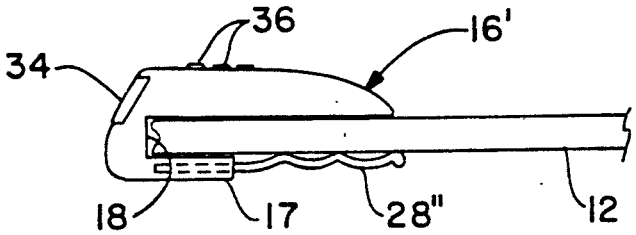
FIG. 9 is an elevational side view of an alternative embodiment of the present invention.

FIG. 9 discloses yet another embodiment of the present invention wherein the timer unit 30 and file attachment member 16 are of a unibody construction. File attachment member 16' is contemplated as being made from a formed plastic material and having an internal cavity containing the microprocessor chip 52 and battery 54. File attachment member 16' is shown as an essentially "J" shaped member having an extending leg member 17 defining a notch 18. A clip member 28" is inserted into the terminal end of leg member 17 and is biased toward the body of file attachment member 16' in order that papers and files are retained therebetween. Leg member 17 is essentially rigid in construction but possessing a minimum range of flexibility so as to permit varying volumes of papers to be introduced and subsequently retained within notch 18. The LCD unit 34 is recessed into the body of file attachment member in a position capable of being viewed along a periphery of the file 12.

Figure 10:
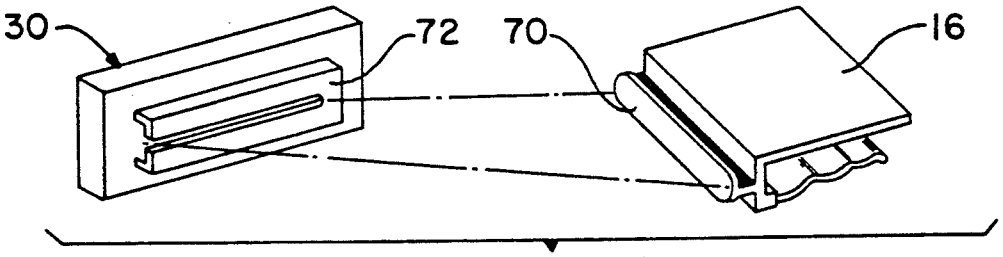
FIG. 10 is an exploded perspective view of an alternative embodiment of the present invention wherein the timer unit is detachable from the file attachment means member.

The device of the present invention is disclosed at FIG. 10 as having a timer unit 30 possessing a means for detaching timer unit 30 from its corresponding file attachment member. One portion of this detachment means is shown as a coupling pin 70 extending outwardly from the file attachment member 16. Correspondingly, timer unit 30 has a coupling seat 72 located preferably on the back side of housing 32 and dimensioned to snapingly receive coupling pin 70 with a friction fit and allowing a timer unit 30 to be removed or moved to other file attachment members 16. However, it is appreciated that numerous means for removably attaching timer unit 30 to document attachment member 16 exist and could readily be substituted for the means demonstrated herein.

It should be readily appreciated that timer unit 30 can be modified to present various predetermined messages and/or methods to signal the imminence of an established deadline. An alternative embodiment of the present incorporates the use of an audible signal to denote the arrival of a predetermined point in advance of the programmed critical date. Still further, connection to one or more light emitting diodes (LED's) is contemplated as an alternative manner in which to alert the individual of a deadline.

While in accordance with the patent statutes, a preferred embodiment and best mode has been presented, the scope of the invention is not limited thereto, but rather is measured by the scope of the attached claim.

What is claimed is:

1. A device for the monitoring of a critical deadline associated with a document having an edge portion comprising:

a document attachment member having a base portion and a clip portion, said clip portion having a first and a second end, said first end attached to said base member and at least said second end biased into contact with at least one document, said document attachment member being physically retained in direct and removable contact on said at least one document at an edge portion of said at least one document; and an electrical circuit means including a housing supported on said base portion of said document attachment member, to allow said circuit means to be selectively attached to said at least one document, said electrical circuit means comprising a timing circuit means for monitoring elapsed time and for producing one or more timing signals at predetermined times relative to said critical deadline, a signalling means for producing a signal capable of human detection, and a control means for receiving said timing signal and energizing said signalling means.

2. The device as recited in claim 1 wherein said device further comprises a manual operable means for actuating and deactivating said electrical circuit means.

3. The device as recited in claim 1, wherein said signal means is a display means for producing a visual signalling.

4. The device as recited in claim 3 wherein said display means comprises a liquid crystal display.

5. The device as recited in claim 1 wherein said signalling means generates an audible signal.

6. The device as recited in claim 1 wherein said signalling means generates both audible and visual signals.

7. The device as recited in claim 1 wherein said document attachment member is a paper clip.

8. The device as recited in claim 1 wherein said document attachment member is a binder clip.

9. The device as recited in claim 1 wherein said document attachment member is a spring biased clasp.

10. The device as recited in claim 1 wherein said electrical circuit means is detachably supported on said document attachment member.

11. The device as recited in claim 1 wherein said document attachment member and said electrical circuit means are combined into a unibody construction.

12. The device as recited in claim 1 wherein said control means includes processing means to allow repeated programming, processing and storing of critical deadline information.

13. The device as recited in claim 3, wherein, said display means is supported on said base portion in a manner such that said display means is visible exterior to said at least one document to which said device is attached.

* * * * *